United States Patent [19]

Weber et al.

[11] Patent Number: 4,723,429

[45] Date of Patent: Feb. 9, 1988

[54] SPEED-COMPENSATED PRESS LOAD MONITORING SYSTEM

[75] Inventors: Daniel R. Weber, Groton; Andrew D. Baker, Brockton, both of Mass.

[73] Assignee: Data Instruments, Inc., Acton, Mass.

[21] Appl. No.: 9,201

[22] Filed: Jan. 30, 1987

[51] Int. Cl.[4] ..... B21D 55/00

[52] U.S. Cl. ..... 72/20; 72/1; 72/8; 72/443; 100/99; 73/808; 361/160

[58] Field of Search ..... 72/1, 8, 11, 19, 21, 72/26, 389, 443; 73/764, 777; 100/99, 53; 361/160, 187

[56] References Cited

U.S. PATENT DOCUMENTS

| | | | |
|---|---|---|---|
| 3,930,248 | 12/1975 | Keller | 100/99 |
| 4,010,679 | 3/1977 | Dybel | 100/99 |
| 4,048,848 | 9/1977 | Dybel | 73/764 |
| 4,062,055 | 12/1977 | Dybel et al. | 361/160 |
| 4,116,050 | 9/1978 | Tanahashi | 100/99 |
| 4,171,646 | 10/1979 | Dybel et al. | 73/808 |
| 4,195,563 | 4/1980 | Budraitis et al. | 100/99 |
| 4,274,282 | 6/1981 | Budraitis | 100/99 |
| 4,289,022 | 9/1981 | Dybel et al. | 100/99 |
| 4,453,421 | 6/1984 | Umano | 100/99 |
| 4,593,547 | 6/1986 | Heiberger | 72/1 |

*Primary Examiner*—Robert L. Spruill
*Assistant Examiner*—David B. Jones
*Attorney, Agent, or Firm*—Schiller, Pandiscio & Kusmer

[57] ABSTRACT

A novel press load monitoring system for a variable speed press which is capable of automatically adjusting the measured load level of the press so as to compensate for strain in the press frame produced by mechanical vibrations occurring as the speed of the press is varied.

16 Claims, 7 Drawing Figures

STROKES PER MINUTE (SPM) = (1/TIME BETWEEN LOAD ENVELOPES) X 60

SPEED-COMPENSATED PRESS LOAD MONITORING SYSTEM

FIELD OF THE INVENTION

This invention relates to press load monitoring systems in general, and more particularly to press load monitoring systems of the sort adapted to work with variable speed metal forming or stamping presses.

BACKGROUND OF THE INVENTION

Metal forming or stamping presses and systems for monitoring the loads on such presses are well known in the art. Looking first at FIG. 1, press load monitoring systems typically comprise one or more strain sensors 5 mounted to the frame 10 of a press 15 for measuring the strain on the frame of the press, and electronic means 20 for (a) calculating the load on the frame of the press from the output of strain sensors 5, (b) comparing the calculated load on the frame of the press to predetermined set points, and (c) automatically shutting down the press if the calculated load on the frame of the press is outside the limits of those predetermined set points. See, for example, U.S. Pat. Nos. 4,048,848, 4,062,055, 4,171,646, and the references cited therein for typical press monitoring systems.

Due to variations in manufacture and operating conditions, both the presses and the press load monitoring systems must generally be initially calibrated before use; the presses must be calibrated to ensure that they strike the workpiece with the desired force, and the press load monitoring systems must be calibrated to ensure that they properly calculate the actual load on the frame of the press from the output of strain sensors 5.

In a constant speed press, the press and the system for monitoring the load on the press are typically initially calibrated as follows. First, a load cell is positioned in the press in place of the normal tooling. This load cell is adapted to register and display the actual impact force generated by the press on the load cell, e.g. 97 tons. The press is started up, the output of the load cell is monitored, and the press is adjusted as necessary until the press is in fact striking the load cell with the desired force, e.g. 100 tons.

After the press has been so calibrated, the press load monitoring system must then be calibrated. Such calibration essentially consists of determining a correct calibration factor (measured in tons/volt) by which the output of strain sensors 5 (measured in volts) must be multiplied in order to correctly yield the actual load being exerted on the frame of the press. More specifically, the calibration factor for the press is computed by utilizing the following equation:

$$\text{actual load (tons)} = \text{calibration factor (tons/volt)} \times \text{strain sensor output (volts)} \quad (1)$$

By way of example, suppose press 5 has just been calibrated so that it is known to be operating at its rated capacity of 100 tons. Suppose also that while the press was striking the load cell with an impact force of 100 tons, strain sensors 5 were showing an output of 5 volts. Then, by applying Equation (1) above and solving for the calibration factor, the appropriate calibration factor for the press is computed, i.e., $$\text{actual load (tons)} = \text{calibration factor (tons/volt)} \times \text{strain sensor output (volts)} \quad (1a)$$

-continued $$100 \text{ tons} = \text{calibration factor} \times 5 \text{ volts} \quad (1b)$$

$$\text{calibration factor} = 100 \text{ tons}/5 \text{ volts} \quad (1c)$$

$$\text{calibration factor} = 20 \text{ tons/volt} \quad (1d)$$

This calibration factor is then stored by the press load monitoring system to be thereafter used whenever the actual load on the frame of the press needs to be determined from the output of strain sensors 5. More specifically, once the press and the press load monitoring system have been calibrated in the foregoing manner, and the press load monitoring system has had its predetermined set points set, e.g. it might be given a "high" set point of 120 tons and a "low" set point of 80 tons, the load cell is replaced by normal tooling and operation of the press is commenced. Thereafter, electronic means 20 monitor the output of strain sensors 5, continually calculating the load on the frame of the press using Equation (1) discussed above, the calibration factor previously determined and the output of strain sensors 5, e.g. if strain sensors 5 were reporting an output of 4.5 volts and the press had a calibration factor of 20 tons/volt, electronic means 20 would calculate a load level of 90 tons on the frame of the press, or if strain sensors 5 were reporting an output of 5.5 volts and the press had a calibration factor of 20 tons/volt, electronic means 20 would calculate a load level of 110 tons on the frame of the press. So long as the load level computed by electronic means 20 (utilizing Equation (1) discussed above, the calibration factor previously determined and the output of strain sensors 5) remains between the predetermined "high" and "low" set points, electronic means 20 allow the press to continue operation uninterrupted; however, as soon as the load level computed by electronic means 20 falls outside the "high" and "low" set points, e.g. above 120 tons or below 80 tons, electronic means 20 will automatically shut down the press.

In a variable speed press, the situation is significantly more complex. This is because during the operation of the press, the frame of the press typically has mechanical resonances in it from the action of the successively opening and closing press members. These mechanical resonances create a periodic "ringing" in the frame of the press that is picked up by the aforementioned strain sensors during operation of the press load monitoring system and is included in the total strain levels reported by the strain sensors to the electronic means 20. It has been found that, for a given press, the strain component attributable to "ringing" in the press frame tends to vary with the speed of the press; at slow press speeds, e.g. 200 strokes per minute (200 "spm"), the strain component from "ringing" tends to be relatively small relative to the total strain levels reported by the strain sensors, whereas at high press speeds, e.g. 1200 spm, the strain component from "ringing" tends to be fairly large relative to the total strain levels reported by the strain sensors. It has also been found that, for a given press, the strain component (as a percentage of load) attributable to "ringing" tends to be fairly constant for a given press speed. See FIGS. 2A and 2B, which show representative strain sensor outputs for a typical variable speed press operating at 200 spm and 1200 spm, respectively.

On account of the foregoing, it is significantly more difficult to properly utilize a press load monitoring system with a variable speed press. More specifically, suppose both the variable speed press and the press load monitoring system are calibrated in the foregoing manner at a relatively low press speed, e.g. 200 spm. The load cell is placed on the press, the press is turned on, and the output of the load cell is monitored and the press is adjusted as necessary until the press is impacting the load cell with the desired force, e.g. 100 tons. With the press operating at its known rating of 100 tons, the output of strain sensors 5 is read and, through the use of Equation (1) above, the appropriate calibration factor for the press is computed, e.g. if strain sensors 5 were reporting an output of 5 volts while the press was generating 100 tons, the calibration factor for the press would once again be 20 tons/volt. Now if the speed of the press should be increased to a relatively high speed, e.g. 1200 spm, while the load cell is left in the press, an interesting phenomena will be observed: the load cell's output might change slightly, e.g. it might drop from 100 tons to 99.5 tons, to reflect certain speed-related changes occurring in the operation of the press such as a tightening of bearings, etc., while at the same time the output of strain sensors 5 will likely change fairly dramatically, e.g. it might increase from 5 volts to 6.5 volts. Electronic means 20 would read this 6.5 volt output, apply the previously determined calibration factor of 20 tons/volt as per Equation (1) above, and conclude that the load on the frame of the press had suddenly increased from 100 tons to 130 tons—which is, of course, in direct contradiction to the current output of the load cell, which is still showing a load of approximately 100 tons. Clearly the increase in the output of strain sensors 5 does not reflect an actual increase in the force generated by the press during its power stroke; in fact, the increase in the output of strain sensors 5 is generally directly traceable to a corresponding increase in the strain component relating to "ringing".

The fact that the strain component attributable to "ringing" varies with the speed of the press presents something of a problem for the press load monitoring system: if the calibration factor for the press is initially calculated at a relatively low rate of speed, e.g. 200 spm, and the "high" and "low" set points appropriately set, e.g. at 120 tons and 80 tons, respectively, and the press is then run at its high rate of speed, e.g. 1200 spm, "ringing" in the press frame will cause electronic means 20 to calculate an erroneously high load level, e.g. 200 tons instead of 100 tons, whereupon the press load monitoring system will then generally erroneously shut down the system. On the other hand, it will also be appreciated that if the calibration factor for the press should be initially calculated at a relatively high rate of speed, e.g. 1200 spm, (i.e., so that calibration is done while the strain sensors are reading a sizeable additional strain component attributable solely to "ringing"), and the "high" and "low" set points set, e.g. at 120 tons and 80 tons, respectively, and the press is then run at its low rate of speed, e.g. 200 spm, the absence of sizeable strain components attributable to "ringing" will then cause electronic means 20 to calculate an erroneously low load level, e.g. 50 tons instead of 100 tons, whereupon the press load monitoring system will then generally also incorrectly shut down the system.

Clearly, speed-related variations in the strain component attributable to "ringing" present serious obstacles to the use of conventional press load monitoring systems with variable speed presses.

The foregoing problem of using conventional press load monitoring systems with variable speed presses is rendered particularly difficult since in practice press operators tend to start a variable speed press at a relatively slow speed, e.g. 200 spm, run it at that slow speed for a brief period to be sure that everything is in order, and then rapidly increase the speed of the press until it reaches a high standard operating speed, e.g. 1200 spm. The problem of properly compensating for speed-related variations in the strain component attributable to "ringing" is aggravated where the speed of the press is frequently and rapidly changed.

In practice, press operators tend to either calibrate the press load monitoring system for the high standard operating speed of the press which is to be ultimately achieved, e.g. they calibrate the press load monitoring system at 1200 spm, or they calibrate the press load monitoring system at the low rate of speed, e.g. 200 spm, and then try to continually adjust the controls of the press load monitoring system manually as the speed of the press changes in an effort to properly compensate for speed-related variations in the strain component relating to "ringing". The former technique guarantees that the press load monitoring system will properly compensate for "ringing" at the high standard operating speed of the press, but such proper compensation at the high standard operating speed is generally at the expense of incorrectly compensating for "ringing" at lower press speeds. As a result, the former technique can totally negate the advantage of a press load monitoring system at these lower press speeds. In addition, the former technique generally requires that an extremely low—or even nonexistent—"low" set point be set to avoid having the press load monitoring systems erroneously shut down the press at low rates of speed. The latter technique, on the other hand, is a nuisance which requires constant operator attention and which can lead to serious problems if the press load monitoring system is not properly readjusted every time the speed of the press is changed.

OBJECTS OF THE INVENTION

Accordingly, the principal object of the present invention is to provide a novel press load monitoring system for a variable speed press which is capable of automatically compensating for speed related variations in the strain component attributable to of "ringing" in the press frame as the speed of the press is varied.

Another object of the present invention is to provide a novel press load monitoring system which is simple, effective, inexpensive to manufacture and reliable to operate.

A further object is to provide a method of monitoring and measuring the strain imposed on the frame of a press so as to compensate for strains related to changes in the operating speed of the press.

SUMMARY OF THE INVENTION

These and other objects of the invention are achieved by a novel press load monitoring system comprising strain sensor means for continually determining the total strain on the frame of the press, speed sensor means for continually determining the current speed of the press, and electronic means responsive to the strain sensor means and the speed sensor means for continually (a) calculating the non-speed-compensated load level of the press from the output of the strain sensor means, (b) modifying the calculated non-speed-compensated load level of the press depending on the output of the speed sensor means so as to derive the speed-compensated load level of the press wherein the speed-variable effects of "ringing" in the press frame have been substantially eliminated, (c) comparing the speed-compensated load level with predetermined set points, and (d) automatically shutting down the press if the speed-compensated load level is outside the limits of those predetermined set points.

BRIEF DESCRIPTION OF THE DRAWINGS

These and other objects and features of the present invention will be more fully disclosed or rendered obvious in the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
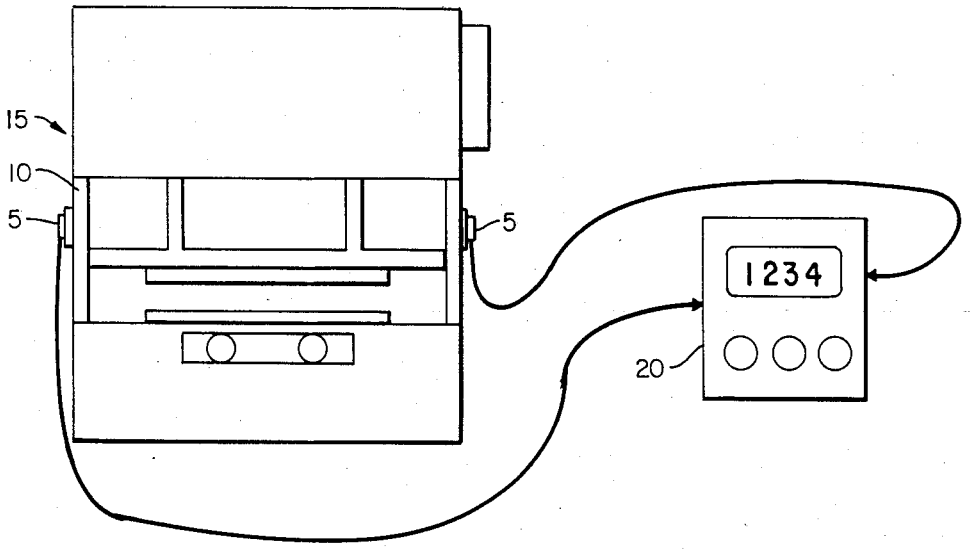
FIG. 1 PRIOR ART
FIG. 1 is a representative view of a typical prior art press load monitoring system, as described above.
Figures 2A, 2B:
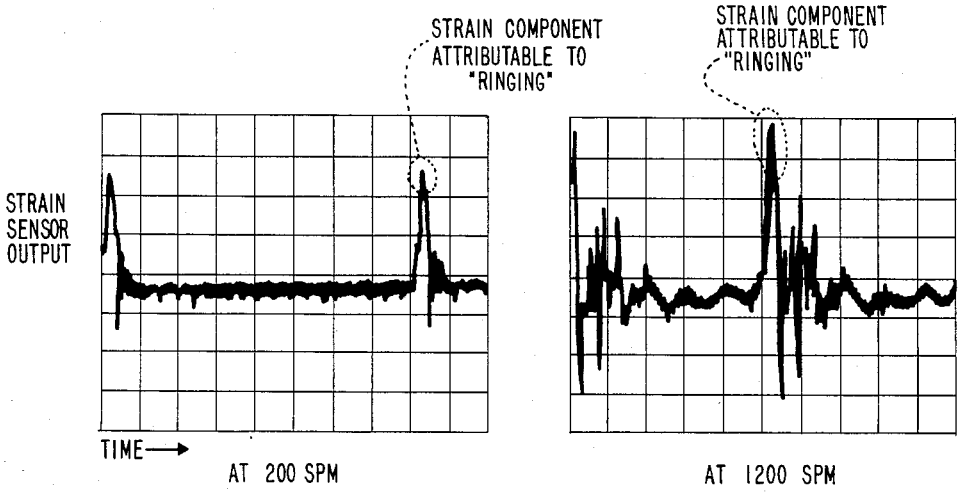
FIGS. 2A and 2B show representative strain sensor outputs for a typical variable speed press operating at 200 spm and 1200 spm, respectively, as described above.
Figure 3:
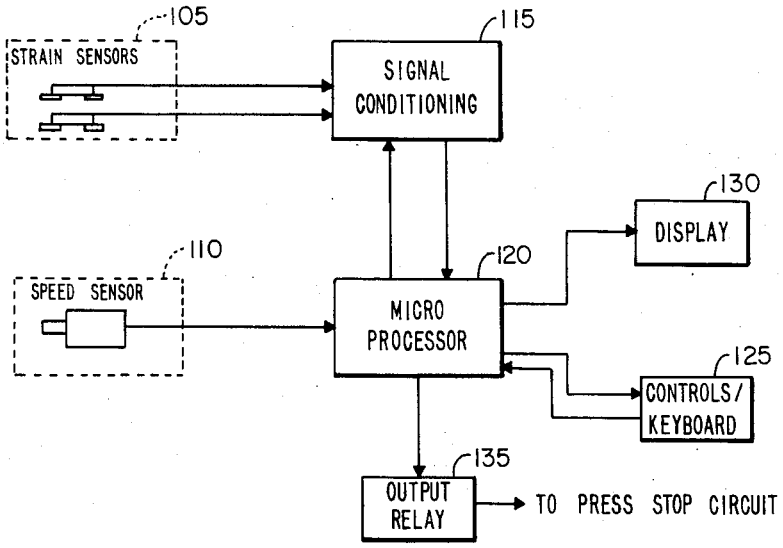
FIG. 3 is a representative view of the various components of a preferred embodiment of the novel press load monitoring system which comprises the present invention.

Looking first at FIG. 3, the preferred embodiment of the present invention generally comprises strain sensor means in the form of one or more strain sensors 105 for determining the total strain on the frame of the press, speed sensor means in the form of a speed sensor 110 for determining the current speed of the press, an output relay 135, and electronic means in the form of signal conditioning apparatus 115, a digital microprocessor 120, a controls/keyboard 125, and a display 130 for continually (a) calculating the non-speed-compensated load level of the press from the outut of strain sensors 105, (b) modifying the calculated non-speed-compensated load level of the press depending on the output of the speed sensor 110 so as to derive the speed-compensated load level of the press wherein the speed variable effects of "ringing" in the press frame have been substantially eliminated, (c) comparing the speed-compensated load level with predetermined set points, and (d) automatically causing relay 135 to shut down the press if the speed-compensated load level is outside the limits of those predetermined set points.

Strain sensors 105 are standard strain sensors of the sort typically used in press load monitoring systems, e.g. they may comprise electrical or electronic strain gauge units (with or without associated amplifier elements) that are adapted to produce an electrical output signal varying according to the level of strain that they detect. Strain sensors 105 can be of the sort which are adapted to produce an electrical output signal in the form of voltage, or strain sensors 105 can be of the sort which are adapted to produce an electrical output signal in the form of current. In prior art systems, the strain sensors are frequently of the sort which are adapted to produce an electrical output signal in the form of voltage, and hence the preceding discussion of the prior art related to output voltages. In the preferred embodiment, strain sensors 105 are also of the sort which are adapted to produce an electrical output signal in the form of voltage, and hence the discussion which follows also relates to output voltages. Strain sensors 105 are mounted to the frame of the press in ways well known in the art and electrically interconnected so as to apply their output signals to signal conditioning apparatus 115. It is to be appreciated that while two strain sensors 105 are shown in FIG. 3, a single strain sensor or three or more strain sensors may be used. If only two strain sensor are used, they are preferably mounted on opposite sides of the press frame.

Speed sensor 110 is a standard speed sensor of the type typically used in press load monitoring systems, being adapted to produce an electrical output signal varying according to the speed detected by the sensor. Speed sensor 110 may be an analog or digital device, e.g. a magnetic type tachometer or an incremental optical encoder. Speed sensor 110 is mounted or coupled to one of the rotating members of the press, e.g. the main operating shaft of the press, in ways well known in the art. Speed sensor 110 is electrically interconnected with microprocessor 120, so that the latter may respond to the output signal of the former.

Signal conditioning apparatus 115 may be of conventional design, comprising electrical components arranged to convert the analog output signal of strain sensors 105 to the digital input signal required by microprocessor 120. In the event that the press load monitoring system includes two or more strain sensors 105, signal conditioning apparatus 115 is preferrably adapted to convert the analog output signal of each of the strain sensors 105 into a separate digital input signal for microprocessor 120, whereby the outputs of the several strain sensors can be independently analyzed by microprocessor 120. (In this regard, it is noted that all of these inputs can be tested against one common set of set points or, alternatively, each of these inputs can be tested against its own particular set of set points.) Alternatively, in the event that the press load monitoring system includes two or more strain sensors 105, signal conditioning apparatus 115 could be adapted to sum the analog output signals of the several strain sensors 105 into a single collective analog output signal and then convert this analog output signal into a single digital input signal for microprocessor 120. However, this latter approach is generally not preferred, since the summing of the various analog output signals into a single collective analog signal could lead to various inaccuracies.

Microprocessor 120 is a standard digital microprocessor of the sort well known in the art. For the purpose of this application, microprocessor 120 is understood to include its normal complement of support chips, as well as the software necessary to make microprocessor 120 operate in the manner hereinafter described.

Controls/keyboard 125 and display 130 provide the means for operator communication with microprocessor 120, while output relay 135 is coupled to the operating system of the press and constitutes the means by which microprocessor 120 may cause the press to shut down. Controls/keyboard 125, display 130, and output relay 135 may take various forms known to persons skilled in the art, and hence are not shown or described in further detail. By way of example, controls/keyboard 125 may take the form of a battery of push buttons, and display 130 may be a CRT-type display, a battery of lights, or a digital display. Relay 135 is typically an electromechanical or solid state relay.

Figure 4:
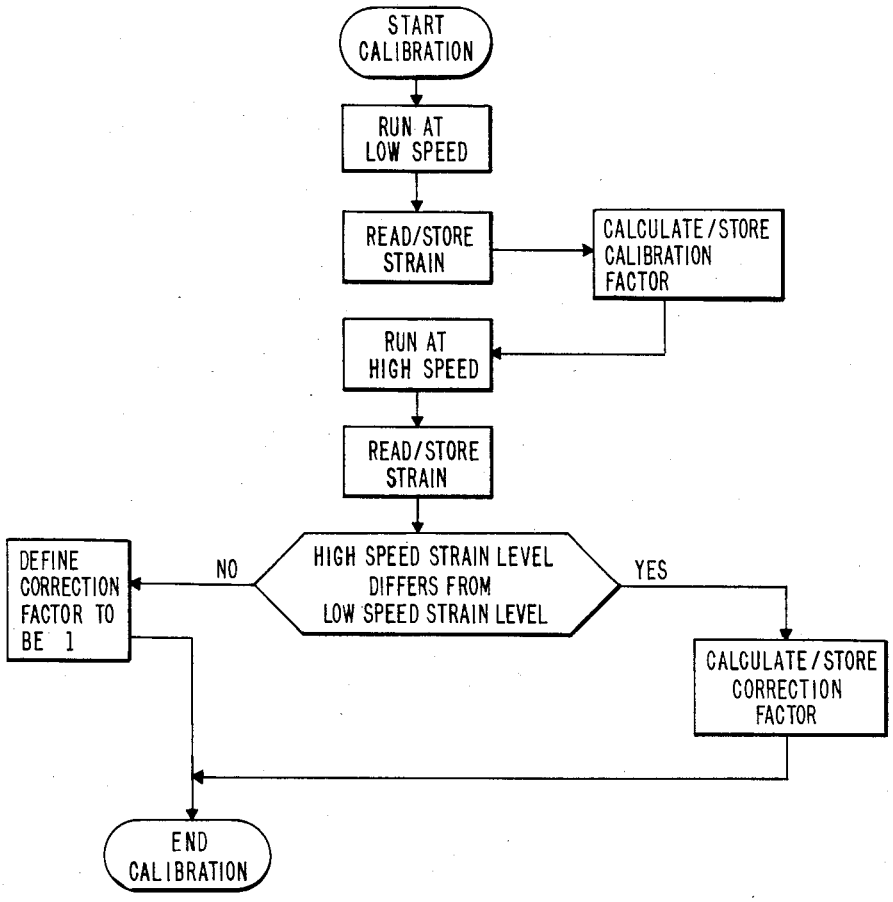
FIG. 4 is a flow chart illustrating how the novel press load monitoring system of FIG. 3 can be initially calibrated.

The novel press load monitoring system is initially calibrated for use with a particular press, preferrably immediately after the press has itself been calibrated, so that the load level on the press is accurately known. The flow chart shown in FIG. 4 illustrates how calibration of the press load monitoring system may be done. First the press is run at a "low" speed. This "low" speed is a speed at which there is presumed to be relatively little "ringing" in the press frame, although it is not necessary for this to be the case. By way of example, that speed may be 200 spm. The strain sensor output from strain sensors 105 is read and stored by microprocessor 120. Next, the calibration factor for the press is calculated using the aforementioned Equation (1), and then stored by the microprocessor. For example, suppose the press is operating at its rated capacity of 100 tons and the output of strain sensors 105 is 5 volts. Then, by using Equation (1), the microprocessor would calculate the calibration factor for the press to be 20 tons/volt. Once the calibration factor for the press has been calculated and stored, the press is run at its "high" standard operating speed, e.g. 1200 spm. This high standard operating speed is generally fast enough so there is substantial "ringing" in the press frame. The strain sensor output from strain sensors 105 is again read and stored by the microprocessor.

If the high speed strain sensor output does not differ significantly from the low speed strain sensor output, the press is exhibiting negligible speed-related variations in "ringing" in its frame and hence microprocessor 120 can calculate an accurate load level for the press at all press speeds, using Equation (1) discussed above, the previously determined calibration factor and the output of strain sensors 105. In effect, it is not necessary to correct the non-speed-compensated load level of the press calculated by microprocessor 120 for speed-related variations in the mechanical resonances in the press frame, since there are negligible variations in those mechanical resonances, before using that load level to determine if the press load is within its predetermined set points. Thus, for example, if strain sensors 105 were outputting 5 volts at 200 spm and 5.01 volts at 1200 spm, the press would in fact be exhibiting negligible speed-related variations in "ringing", and the variable speed press could simply use its low speed calibration factor and the aforementioned Equation (1) to accurately calculate the press load at all press speeds.

If, however, the high speed strain sensor output does differ significantly from the low speed strain sensor output, the press is exhibiting significant speed-related variations in "ringing" in its frame and hence the microprocessor cannot calculate an accurate load level for the press at all press speeds using simply Equation (1) discussed above, the previously determined calibration factor and the output of strain sensors 105. In effect, it is necessary to correct the non-speed-compensated load level of the press calculated by microprocessor 120 for speed-related variations in the mechanical resonances in the press frame, since there are in fact substantial variations in those mechanical resonances, before using that load level to determine if the press load is within its predetermined set points. Instead, a correction factor must be determined which, when properly applied to the calculated non-speed-compensated load level of the press, will correctly yield the true speed-compensated load level of the press. This true speed-compensated load level of the press can then be used to determine if the press load is within its predetermined set points.

In the event that the high speed sensor output does not differ significantly from the low speed sensor output (i.e., so that it is not necessary to correct the non-speed-compensated load level of the press calculated by microprocessor 120 for speed-related variations in the mechanical resonances before using that load level to determine if the press load is within its predetermined set points), the correction factor for the variable speed press is automatically defined to be unity, i.e., 1.

In the event that the high speed sensor output does differ significantly from the low speed sensor output (i.e., so that it is necessary to correct the non-speed-compensated load level of the press calculated by microprocessor 120 for speed-related variations in the mechanical resonances before using that load level to determine if the press load is within its set points), the correction factor for the variable speed press is computed by first running the press at its low speed, applying the aforementioned calibration factor to the output of strain sensors 105 as per Equation (1) to determine the non-speed-compensated low speed load level, and storing the same, and then running the press at its high speed, applying the calibration factor to the output of strain sensors 105 as per Equation (1) to determine the non-speed-compensated high speed load level, and then storing the same; the correction factor for the variable speed press is then determined using the equation:

$$\text{correction factor} = \frac{\text{non-speed-compensated high speed load level (tons)}}{\text{non-speed-compensated low speed load level (tons)}} \quad (2)$$

For example, suppose that a press rated at 100 tons is run at its slow speed of 200 spm, and the total strain sensor output is 5 volts, so that the calibration factor for the press is 20 tons/volt. Suppose further that when the same press is run at its high standard operating speed of 1200 spm, the strain sensor output is 10 volts, so that the non-speed-compensated load level is computed (by use of Equation (1)) to be 200 tons (i.e., 20 tons/volt$\times$10 volts=200 tons). Then, using Equation (2) above, the correction factor for the press is computed to be 2, i.e., $$\text{correction factor} = \frac{\text{non-speed-compensated high speed load level (tons)}}{\text{non-speed-compensated low speed load level (tons)}} \quad (2a)$$

$$\text{correction factor} = 200 \text{ tons}/100 \text{ tons} \quad (2b)$$

$$\text{correction factor} = 2 \quad (2c)$$

This correction factor can then be used to determine the speed-compensated load level of the press in the manner which will hereinafter be described.

Figure 5:
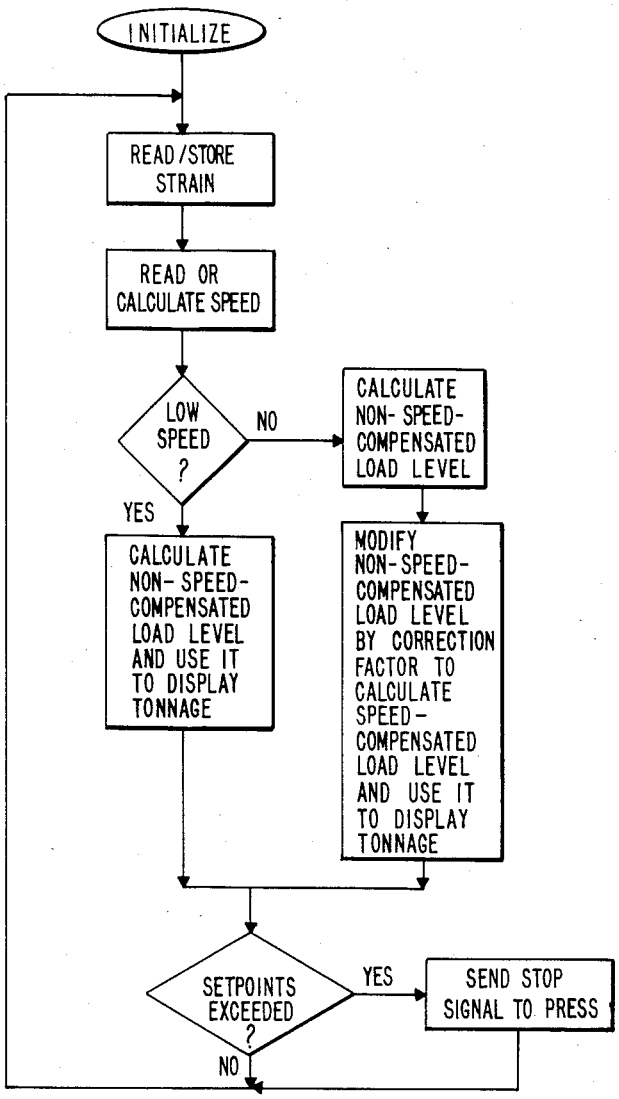
FIG. 5 is a flow chart illustrating operation of the novel press load monitoring system.

The system is arranged so that once it has been calibrated in the foregoing manner and the correction factor calculated and stored, it operates in accordance with the flow chart shown in FIG. 5. More specifically, when the system is first turned on, it initializes itself.

Such initializing typically involves conducting "overhead" operations such as self-testing by the microprocessor, clearing of internal microprocessor flags, establishing an initial condition for display 130, etc. Thereafter, as the press operates, the press load monitoring system acts through microprocessor 120 to read and store the strain output from strain sensors 105, and read the speed output from speed sensor 110.

If the press speed is "low", e.g. 200 spm, so that the press is operating at precisely the speed at which the calibration factor for the press was determined, the level of "ringing" in the frame will be precisely that which was occurring at the time of calibration. As a result, microprocessor 120 can calculate an accurate load level for the press simply by using Equation (1) discussed above, the previously determined calibration factor and the output of strain sensors 105. In effect, when the press is operating at that low speed of 200 spm, the non-speed-compensated load level yielded by the application of Equation (1) is also the same as the speed-compensated load level, and thus this load level may be used without further modification to determine if the load is within the predetermined set points.

If on the other hand, the press speed is not "low", e.g. it is at some speed other than 200 spm, so that the press is not operating at precisely the speed at which the calibration factor for the press was determined, the level of "ringing" in the frame is likely to be significantly different from that which was occurring at the time of calibration. As a result, microprocessor 120 cannot calculate an accurate load level for the press simply by using Equation (1) discussed above, the previously determined calibration factor and the output of strain sensors 105, since this process yields a non-speed-compensated load level. Instead, microprocessor 120 must calculate the speed-compensated load level for the press using the equation:

$$\text{speed-compensated load level at speed } x = \text{non-speed-compensated load level at speed } x \,/(1 + \%\text{ speed } x \text{ (correction factor} - 1)) \quad (3)$$

where $$\%\text{ speed} = (\text{actual speed } x - \text{low speed})/(\text{high speed} - \text{low speed}) \quad (4)$$

For example, suppose a press rated at 100 tons is run at its slow speed of 200 spm and has a strain sensor output of 5 volts (so that the calibration factor for the press is 20 tons/volt), and is run at its high speed and has a strain sensor output of 10 volts (so that the correction factor for the variable speed press is 2). At 700 spm, the press is observed to have a strain sensor output of 7.5 volts, which yields a non-speed-compensated load level at 150 tons; of course, since the press is rated at 100 tons, the speed-compensated load level of the press should still be 100 tons and, applying Equations (3) and (4) above, it can in fact be shown to be that, i.e.,:

$$\%\text{ speed} = (\text{actual speed } x - \text{low speed})/(\text{high speed} - \text{low speed}) \quad (4a)$$

$$\%\text{ speed} = (700\text{–}200)/(1200\text{–}200) \quad (4b)$$

$$\%\text{ speed} = 500/1000 \quad (4c)$$

$$\%\text{ speed} = 1/2 \quad (4d)$$

and

-continued $$\text{speed-compensated load level at speed } x = \text{non-speed-compensated load level at speed } x \,/(1 + \%\text{ speed } x \text{ (correction factor} - 1)) \quad (3a)$$

$$\text{speed-compensated load level at speed } x = 150\text{ tons}/(1 + 1/2 \times (2\text{–}1)) \quad (3b)$$

$$\text{speed-compensated load level at speed } x = 150\text{ tons}/(1 + 1/2) \quad (3c)$$

$$\text{speed-compensated load level at speed 700 } spm = 150\text{ tons}/1.5 = 100\text{ tons} \quad (3d)$$

(It is also to be appreciated that where on calibration the press was shown to have no substantial speed-variable "ringing" in the frame, the fact that the correction factor for the press is defined to be 1 means that Equation (3) will always return a situation where the speed-compensated load level at speed x is equal to the non-speed-compensated load level at speed x, since the factor % speed will be multiplied by the value of (1 − 1), or 0, i.e.:

$$\text{speed-compensated load level at speed } x = \text{non-speed-compensated load level at speed } x \,/(1 + \%\text{ speed } x \text{ (correction factor} - 1)) \quad (3e)$$

$$\text{speed-compensated load level at speed } x = \text{non-speed-compensated load level at speed } x \,/(1 + \%\text{ speed} \times 0) \quad (3f)$$

$$\text{speed-compensated load level at speed } x = \text{non-speed-compensated load level at speed } x \,/1 \quad (3g)$$

$$\text{speed-compensated load level at speed } x = \text{non-speed-compensated load level at speed } x \quad (3h)$$

Of course, it is to be appreciated that the resultant Equation (3h) relates only to the special condition where the correction factor for the press is defined to be 1, i.e., where the press is exhibiting essentially no speed-variable changes in "ringing" in the press.)

Once the speed-compensated load level has been determined, the microprocessor checks to see if that load level is outside the limits of the predetermined set points; if the load level does not lie outside the limits of the predetermined set points, the load is still within its operating limits and the press is allowed to continue operating. On the other hand, if the load level does lie outside the limits of the predetermined set points, the microprocessor causes output relay 135 to send a signal to stop the press. Thereafter, the system cycles back to repeat the foregoing monitoring process over and over as long as the press is operating.

For example, suppose a press and its associated press load system are initially calibrated, wherein the system has a calibration factor of 20 tons/volt and a correction factor of 2. Suppose also that at some time T1, the press load monitoring system read the total strain output from strain sensors 105 to be 6 volts and saved the same, and read the output of speed sensor 110 to be 200 spm. Since the press speed is then "low", i.e., 200 spm, there is exactly the same level of "ringing" in the press frame at that point and as there was when the calibration factor was determined. As a result, microprocessor 120 can compute the actual load level of the press merely by using Equation (1) discussed above, the previously determined calibration factor and the output of strain sensors 105. Accordingly, microprocessor 120 will calculate the load to be 120 tons and display the same. If the calculated press load is outside the limits of the predetermined set points, the press is automatically shut down by microprocessor 120; however, if the calculated press load does not lie outside the limits of the predetermined set points, the microprocessor allows the press to continue running.

Continuing further with the press operation, suppose at some time T2, the press load monitoring system read the strain output from strain sensors 105 to be 9 volts and saved the same, and read the output of speed sensors 110 to be 1100 spm. Since the press speed is not then "low", the level of "ringing" in the press is likely to be significantly different at that point then that which was occurring at the time of calibration. As a result, microprocessor 120 cannot calculate an accurate load level for the press simply by using Equation (1) discussed above, the previously determined calibration factor and the output of strain sensors 105, since this process yields a non-speed-compensated load level. Instead, microprocessor 120 must first calculate the non-speed-compensated load level at 1100 spm using Equation (1) and, doing so, determines it to be 180 tons, i.e., $$\text{non-speed-compensated load level at 1100 } spm = \text{calibration factor} \times \text{strain sensor output} \quad (1e)$$

$$\text{non-speed-compensated load level at 1100 } spm = 20 \text{ tons/volt} \times 9 \text{ volts} \quad (1f)$$

$$\text{non-speed-compensated load level at 1100 } spm = 180 \text{ tons} \quad (1g)$$

Next, the microprocessor calculates the % speed variable using Equation (4) and, doing so, determines it to be 9/10, i.e., $$\%\ \text{speed} = (\text{actual speed x} - \text{low speed})/(\text{high speed} - \text{low speed}) \quad (4e)$$

$$\%\ \text{speed} = (1100-200)/(1200-200) \quad (4f)$$

$$\%\ \text{speed} = (900)/(1000) = 9/10 \quad (4g)$$

Finally microprocessor 120 calculates the speed-compensated load level at 1100 spm using Equation (3) and, doing so, determines it to be 94.7 tons, i.e., $$\text{speed-compensated load level at speed } x = \text{non-speed-compensated load level at speed } x \,/(1 + \%\ \text{speed } x\ (\text{correction factor} - 1)) \quad (3i)$$

$$\text{speed-compensated load level at 1100 } spm = 180 \text{ tons}/(1 + .9 \times (2-1)) \quad (3j)$$

-continued $$\text{speed-compensated load level at 1100 } spm = 180 \text{ tons}/(1.9) \quad (3k)$$

$$\text{speed-compensated load level at 1100 } spm = 94.7 \text{ tons} \quad (3l)$$

Accordingly, microprocessor 120 will calculate the true load to be 94.7 tons and display the same. If the calculated press load is outside the limits of the predetermined set points, the press is automatically shut down by operation of relay 135 under the instigation of microprocessor 120. On the other hand, if the caculated press load does not lie outside the limits of the predetermined set points, the microprocessor allows the press to continue running.

MODIFICATIONS OF THE PREFERRED EMBODIMENT

It is, of course, possible to modify the foregoing preferred embodiment of the invention without departing from the scope of the present invention.

Thus, for example, in the foregoing embodiment the speed-related load correction factor was determined as per Equation (2) by first running the press at a low speed, and determining the non-speed-compensated low speed load level, then running the press at its high operating speed and determining the non-speed-compensated high speed load level, and then dividing the high speed load level by the low speed load level to yield a correction factor. This correction factor is then utilized in Equation (3) to devise the speed-compensated load level. This technique is quite effective if there is a substantially linear relationship between press and speed and speed-related variations in the strain component relating to "ringing". Fortunately, such a relationship seems to exist for many presses. However, in some situations a press may not exhibit a substantially linear relationship between press speed and speed-related variations in the strain component relating to "ringing", at least over the entire range of press speeds. In such event, it may be necessary to subdivide the range of press speeds into two or more smaller speed ranges where there is a substantially linear relationship between press speed and speed-related variations in the strain component relating to "ringing", and compute different correction factors for each of these small speed ranges.

It is even anticipated that for some presses the relationship between press speed and speed-related variations in the strain component relating to "ringing" may be so non-linear that it may be necessary to calculate an appropriate correction factor for every different press speed and store them in an appropriate look-up table, whereupon the microprocessor would be able to supply a precise correction factor for each possible press speed as the speed of the press is varied.

Figure 6:
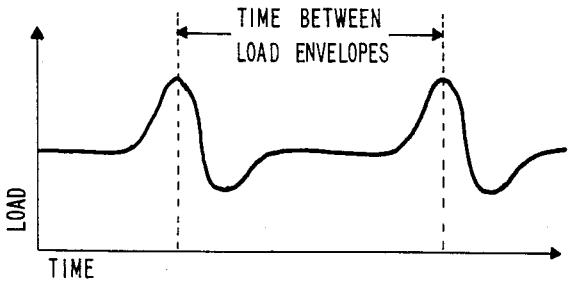
FIG. 6 is a graph illustrating how press speed can alternatively be determined from load envelopes derived from the strain sensors rather than by separate speed sensor components.

It is also anticipated that the system could be modified so as to calculate the press speed from the output of strain sensors 105 (i.e., the time interval between each strain peak) rather than by using speed sensors 110. In such event, the microprocessor would be programmed to use the time period between the strain envelopes output by strain sensors 105 to derive the press speed (see FIG. 6). Speed sensors 110 could then be completely omitted from the invention apparatus.

ADVANTAGES OF THE INVENTION

The present invention provides a novel press load monitoring system for a variable speed press which is capable of automatically compensating for speed-related variations in the strain component attributable to "ringing" in the press frame as the speed of the press is varied.

The present invention also provides a novel press load monitoring system which is simple, effective, inexpensive to manufacture and reliable to use.

The present invention also provides a method of monitoring and measuring the strain imposed on the frame of the press so as to compensate for strains related to changes in the operating speed of the press.

What we claim is:

1. A press load monitoring system for determining the speed-compensated load level of a variable speed press, comprising:

strain sensor means for continually determining the strain on the frame of the press as the press is operating;

speed sensor means for continually determining the speed of said press as the press is operating; and means responsive to said strain sensor means and said speed sensor means for continually (a) calculating a non-speed-compensated load level of the press from the output of said strain sensor means, (b) modifying the calculated non-speed-compensated load level of the press depending on the output of said speed sensor means so as to derive the speed-compensated load level of the press wherein the speed-variable effects of "ringing" in the press frame have been substantially eliminated, (c) comparing the speed-compensated load level with predetermined set points and (d) automatically shutting down the press if the speed-compensated load level is outside the limits of said predetermined set points.

2. A method of monitoring the load on a variable speed press so as to compensate for speed-related strains in the frame of the press, comprising the steps of:

(1) continually determining the strain on the frame of the press as the press is operating;

(2) continually determining the speed of said press as the press is operating; and (3) continually (a) modifying the strain determined for the frame of the press in accordance with the speed of the press so as to remove from said strain the strain component produced by mechanical resonances in the frame of said press and thereby derive the speed-compensated strain on the press, (b) comparing a load level determined by the speed-compensated strain with a predetermined load level, and (c) automatically shutting down the press if the load level represented by the speed-compensated strain is outside the limits of said predetermined load level.

3. A press load monitoring system according to claim 1 wherein said strain sensor means is adapted to produce an electrical output signal in the form of voltage.

4. A press load monitoring system according to claim 1 wherein said strain sensor means is adapted to produce an electrical output signal in the form of current.

5. A press load monitoring system according to claim 1 wherein said strain sensor means comprises two or more independent strain sensors.

6. A press load monitoring system according to claim 5 wherein said means responsive to said strain sensor means and said speed sensor means calculates the non-speed-compensated load level of the press from the output of said strain sensor means independently for each of said two or more independent strain sensors.

7. A press load monitoring system according to claim 5 wherein said means responsive to said strain sensor means and said speed sensor means calculates the non-speed-compensated load level of the press from the sum of the output signals of said two or more independent strain sensors.

8. A press load monitoring system according to claim 1 wherein said speed sensor means is a magnetic type of tachometer.

9. A press load monitoring system according to claim 1 wherein said speed sensor means is an incremetal optical encoder.

10. A method according to claim 2 wherein at least one strain sensor is used to continually determine the strain on the frame of the press as the press is operating, said at least one strain sensor being adapted to produce an electrical output signal in the form of voltage.

11. A method according to claim 2 wherein at least one strain sensor is used to continually determine the strain on the frame of the press as the press is operating, said at least one strain sensor being adapted to produce an electrical output signal in the form of current.

12. A method according to claim 2 wherein two or more independent strain sensors are used to continually determine the strain on the frame of the press as the press is operating.

13. A method according to claim 12 wherein the output from each of said two or more independent strain sensors is independently used to continually determine the strain on the frame of the press as the press is operating.

14. A method according to claim 12 wherein the outputs from each of said two or more independent strain sensors are summed to continually determine the strain on the frame of the press as the press is operating.

15. A method according to claim 2 wherein a magnetic type of tachometer is used to continually determine the speed of the press as the press is operating.

16. A method according to claim 2 wherein an incremental optical encoder is used to continually determine the speed of the press as the press is operating.

* * * * *